US005908775A

United States Patent [19]

Sugiura et al.

[11] Patent Number: 5,908,775

[45] Date of Patent: Jun. 1, 1999

[54] METHOD OF TEXTILE PRINTING BY MICROORGANISM AND MICROORGANISM FOR DECOLORIZATION OF AZO-SYSTEM DYE

[75] Inventors: Wataru Sugiura, Osaka; Keiko Nagai; Tadashi Yokoyama, both of Kanagawa, all of Japan

[73] Assignees: Okasa Prefecture, Osaka; Yushiro Chemical Industry Co., Ltd., Tokyo, both of Japan

[21] Appl. No.: 08/528,197

[22] Filed: Sep. 14, 1995

[51] Int. Cl.[6] ..... D06M 16/00

[52] U.S. Cl. ..... 435/263; 435/252.5; 435/832; 8/445; 8/448; 8/451; 8/457; 8/458

[58] Field of Search ..... 435/263, 832, 435/252.5; 8/448, 451, 457, 458, 445

[56] References Cited

U.S. PATENT DOCUMENTS

| | | | |
|---|---|---|---|
| 4,313,731 | 2/1982 | Imahori et al. | 8/451 |
| 4,386,935 | 6/1983 | Bühler et al. | 8/451 |
| 4,406,661 | 9/1983 | Bühler et al. | 8/464 |
| 4,420,308 | 12/1983 | Bühler et al. | 8/464 |
| 5,091,089 | 2/1992 | Shen et al. | 210/611 |
| 5,418,161 | 5/1995 | Mark et al. | 435/252.1 |
| 5,512,061 | 4/1996 | Von Der Eltz et al. | 8/480 |
| 5,550,217 | 8/1996 | Trottmann | 534/732 |

FOREIGN PATENT DOCUMENTS

| | | |
|---|---|---|
| 07097783 | 4/1995 | Japan . |
| 07097784 | 4/1995 | Japan . |
| 07097785 | 4/1995 | Japan . |
| 08000261 | 1/1996 | Japan . |

OTHER PUBLICATIONS

Wuhrmann, K., et al., "Investigation on Rate—Determining Factors in the Microbial Reduction of Azo Dyes", European Journal of Applied Microbiology and Biotechnology, Sep. 1980, pp. 325–338.

*Primary Examiner*—Milton Cano
*Attorney, Agent, or Firm*—Morgan, Lewis & Bockius LLP

[57] ABSTRACT

The invention provides a method of textile printing using microorganisms with less limitation to dyes with less damage on base materials, and with less blurring of color borders. The method is capable of producing a complex, fine pattern; capable of realizing colored discharge printing with brilliant colors; and capable of readily producing an ombre pattern. The invention also provides a microorganism for decolorization of azo-system dye and use in the textile printing method. In accordance with the invention, textile printing is carried out by coating a solution or paste (which may contain a dye) containing a bacterial strain Bacillus OY1-2 of genus Bacillus (Deposit Number: FERM 13118), in a desirable pattern on the cloth dyed with an azo dye (which may include a non-azo dye), subsequently proliferating or acting the bacterial strain while keeping the strain in a wet state, and to entirely or partially metabolize the azo dye to eliminate or decrease the coloring of the azo dye for textile printing. The method may be used, for example, in direct textile printing, white discharge printing, colored discharge printing or reserve printing. A non-colored base material can be combined with the solution containing the bacterial strains and azo dyes and the like as described above.

8 Claims, 1 Drawing Sheet

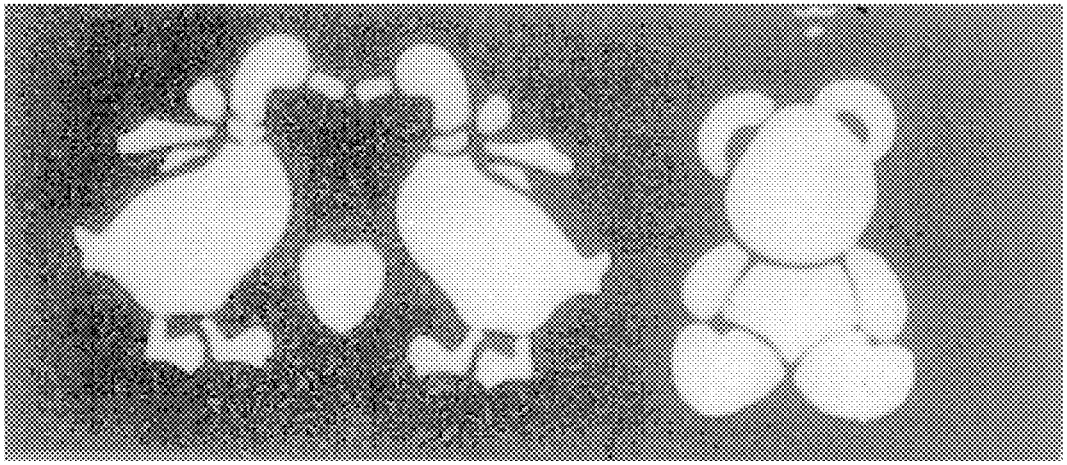
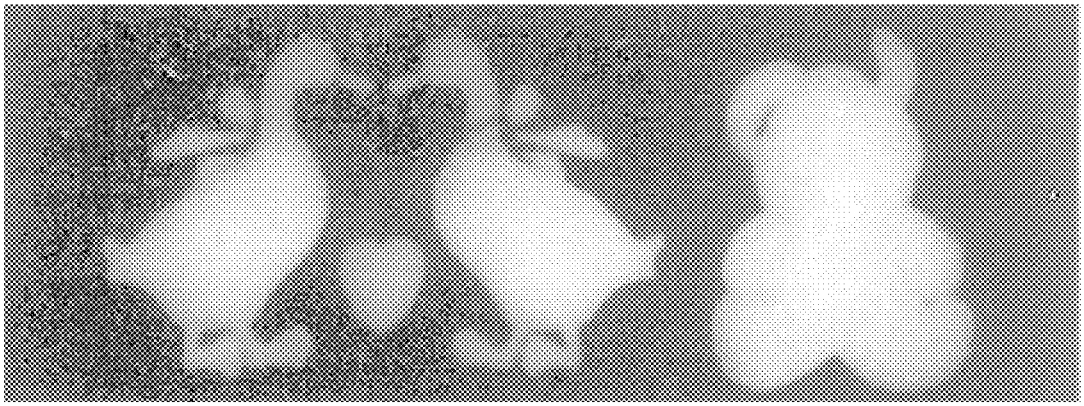
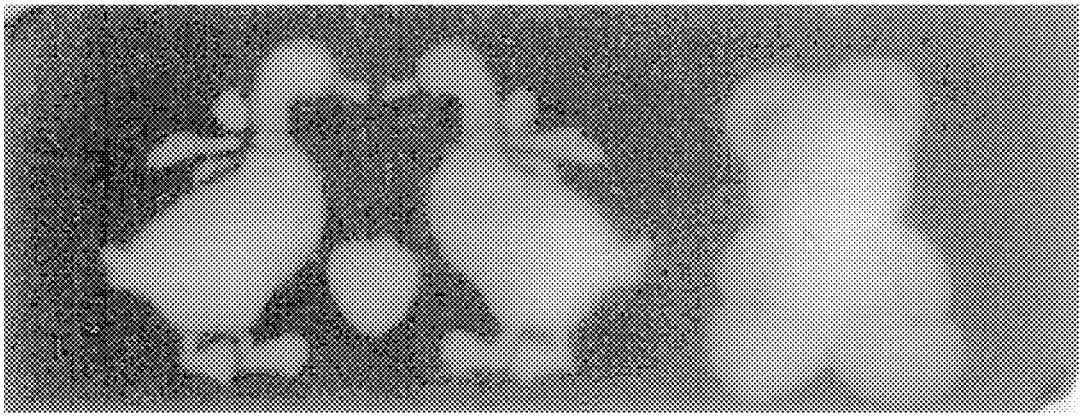

METHOD OF TEXTILE PRINTING BY MICROORGANISM AND MICROORGANISM FOR DECOLORIZATION OF AZO-SYSTEM DYE

BACKGROUND OF THE INVENTION

The present invention relates to a method of textile printing by microorganism and a microorganism for decolorization of azo system dye. More specifically, the present invention relates to a textile printing method using a specific bacterium, comprising treating a base material colored with an azo-system dye or with a azo-system dye together with a non azo-system dye or a base material with a pattern printed thereon by means of a paste solution containing at least the specific bacterium (and another azo-system dye). Additionally, the present invention also relates to a microorganism for decoloring azo system dyes. The microorganism being capable of metabolizing the azo system dyes.

The term "textile printing" includes direct textile printing (printing a pattern on a white base material or a ground dyed base material), discharge printing [printing a pattern on a ground dyed base material (including white discharge printing, colored discharge printing and semi-discharge printing)] and reserve printing (comprising dyeing after drawing a pattern with a substance inhibiting the dyeing).

For the "discharge printing" , there is carried out 1. "white discharge printing" comprising depositing a paste solution containing a reducing agent or an alkali on primarily solid dyed cloth following a desired pattern for thermal processing, to facilitate decolorization via the reduction or the saponification of the carboxylate of a dispersion dye, thereby producing the pattern in white; 2. so-called "colored discharge printing" comprising effecting bleaching along with dyeing with another color; and 3. "semi-discharge printing" comprising terminating the white discharge printing during its intermediate stage, thereby leaving a pattern in slightly paler color than the base color. Furthermore, the "direct textile printing" comprises coating (printing, etc.) a given pattern on a base material using a predetermined color paste, subsequently drying the material, and steaming and washing the material for final finishing.

According to the aforementioned textile printing methods (the color discharge printing in particular), a reducing agent or an alkali is used for bleaching, so that it is required that the dye for preliminary solid dyeing (so-called dye for ground dyeing) should be a dye which can be decolored readily. Furthermore, the textile printing is limited in that the printing dye (dye of effect color for printing) should he a dye resistant to reduction and alkalis during decolorization. The textile printing is disadvantageous in that cloth may be damaged with reducing agents and that halation (blurring in the border of colors) may occur readily.

SUMMARY OF THE INVENTION

The present invention can overcome the aforementioned drawbacks, The object of the present invention is to provide a method of textile printing by microorganisms, with less limitation to dyes and less damage on base materials, additionally with less blurring in the border of colors and being capable of producing a complex, fine pattern, capable of realizing colored discharge printing with brilliant colors and furthermore capable of readily producing an ombre pattern. Additionally, the object of the present invention is to provide a microorganism for decolorization of azo-system dye, which is capable of metabolizing the azo-system dyes, whereby the useful textile printing is established as described above.

Focusing attention to microbial decoloring of azo-system dyes, the present inventors have made screening so as to find a microorganism capable of decoloring azo-system dyes in sludge or soil of dyeing waste water disposal. Then, the inventors have found that a bacterial strain Bacillus OY1-2 of genus Bacillus, Xanthomonas NR25-2 and Achromobacter PR41-1 decolor azo-system dyes. Thus, the inventors have achieved the present invention.

A first aspect of the present invent ion is a microbial textile printing method, comprising coating a solution or paste containing at least a bacterial strain Bacillus OY1-2 of genus Bacillus (Deposit No. FERM 13118) among an azo--system dye, a non-azo-system dye and the bacterial strain, in a desirable pattern on a colored base material dyed with another azo-system dye, subsequently proliferating the bacteria or making the bacteria act in a wet state, to entirely or partially metabolize the azo-system dyes to eliminate or decrease the coloring of the azo-system dyes for textile printing.

A second aspect of the present invention is a method of textile printing by microorganism, comprising coating a solution or paste containing at least a bacterial strain Bacillus OY1-2 of genus Bacillus (Deposit No. FERM 13118) among an azo-system dye, a non-azo-system dye and the bacterial strain, in a desirable pattern on a complexly colored base material dyed with another azo-system dye and another non-azo-system dye, subsequently proliferating the bacteria or making the bacteria act in a wet state, to entirely or partially metabolize the azo-system dyes to eliminate or decrease the coloring of the azo-system dyes for textile printing.

A third aspect of the present invention is a method of textile printing by microorganism, comprising coating a solution or paste containing at least a bacterial strain Bacillus OY1-2 of genus Bacillus (Deposit No. FERM 13118) and an azo-system dye among the azo-system dye, a non-azo-system dye and the bacterial strain, in a desirable pattern on a non-colored base material or a colored base material dyed with another non-azo-system dye, subsequently proliferating the bacteria or making the bacteria act in a wet state, to entirely or partially metabolize the azo-system dye to eliminate or decrease the coloring of the azo-system dye for textile printing.

According to the method of textile printing by microorganism of the first to the third aspects of the present invention, the temperature for metabolizing azo-system dyes is defined at 30 to 50° C.

The microbial textile printing methods according to the first to the third aspect of the present invention are a method wherein on a part of the desirable pattern formed by coating a solution or paste solution containing the aforementioned bacterial strain is carried out at least one of (1). a process of drawing a pattern, under heating to a temperature above 55° C.; (2). a process of drawing a pattern with an alkali solution or paste, pH 9.0 or more or with an acid solution or paste, pH 4.0 or less; and (3). a process of drawing a pattern with a disinfectant. Therefore, the textile printing is referred to as the so-called "reserve printing" . In other words, by drawing a pattern using a solution or paste inhibiting the bacterial proliferation (inhibiting the metabolism (metabolic reaction)), the decolorization of the part is prevented to maintain the coloring of an azo-system dye, thereby achieving textile printing.

The reason of heating above 55° C. as described above is that the reaction activity of the bacteria can be inhibited thereby. The heating means is not particularly limited. The types of individual alkali components or acid components contained in the alkaline solution and the like and the acid solution and the like, are not limited. As the disinfectant (including sterilizing agents), use may be made of any of known various ones, for example, invert soap (trimethyldodecylammonium chloride and the like), salts of heavy metals ($Ag^+$, $Hg^{2+}$), an aqueous 50 to 70% ethanol solution, a cresol solution or an aqueous sodium chloride solution of a high concentration above 5%, etc.

By widely selecting the given temperature (which may be above 55° C. or below the temperature), and the pH (which may be above 9 or below 4 or a pH besides the ranges) and the type and concentration of the disinfectant, and additionally the processing time, and the like, the proliferation of microorganism may be inhibited, nearly completely or incompletely. In the latter case, an ombre pattern (a pattern with different colors) may be produced, or by combination of the two, a further complex and beautiful pattern may be prepared.

A microorganism for decoloring azo-system dyes, in accordance with a seventh aspect of the present invention, which may be used in the textile printing method of the first to the third aspect of the present invention, belongs to the bacterial strain Bacillus OY1-2 (Deposit No. FERM 13118) of genus Bacillus, which characteristically metabolizes the azo-system dyes and eliminates or decreases the coloring of the azo-system dyes. The microorganism for decoloring azo-system dyes can proliferate at 20 to 50° C. In other words, the present microorganism is extremely useful in that the microorganism has an activity at a relatively high temperature of 40 to 50° C.

A method of textile printing by microorganism of a fourth aspect of the present invention comprises coating a solution or paste containing at least a bacterial strain Xanthomonas NR25-2 (Deposit No. FERM 13119) of genus Xanthomonas or Achromobacter PR41-1 (Deposit No. FERM 13120) of genus Achromobacter among an azo-system dye, a non-azo-system dye and the bacterial strain Xanthomonas NR25-2 or Achromobacter PR41-1, in a desirable pattern on a colored base material dyed with another azo-system dye, subsequently proliferating the bacteria or making the bacteria act in a wet state, to entirely or partially metabolize the azo-system dyes to eliminate or decrease the coloring of the azo-system dyes for textile printing.

A method of textile printing by microorganism of a fifth aspect of the present invention that comprises coating a solution or paste containing at least a bacterial strain Xanthomonas NR25-2 (Deposit No. FERM 13119) of genus Xanthomonas or Achromobacter PR41-1 (Deposit No. FERM 13120) of genus Achromobacter among an azo system dye, a non-azo-system dye and the bacterial strain Xanthomonas NR25-2 or Achromobacter PR41-1, in a desirable pattern on a complexly colored base material dyed with another azo-system dye and another non-azo-system dye, subsequently proliferating the bacteria or making the bacteria act in a wet state, to entirely or partially metabolize the azo-system dyes to eliminate or decrease the coloring of the azo-system dyes for textile printing.

A sixth aspect of the method of textile printing by microorganism of the present invention comprises coating a solution or paste containing at least an azo-system dye and a bacterial strain Xanthomonas NR25--2 (Deposit No. FERM 13119) of genus Xanthomonas or Achromobacter PR41-1 (Deposit No. FERM 13120) of genus Achromobacter among the azo-system dye, a non-azo-system dye and the bacterial strain Xanthomonas NR25-2 or Achromobacter PR41-1, in a desirable pattern on a non-colored base material or a colored base material dyed with another non-azo-system dye, subsequently proliferating the bacteria or making the bacteria act in a wet state, to entirely or partially metabolize the azo-system dye to eliminate or decrease the coloring of the azo-system dye for textile printing.

In accordance with the method of textile printing by microorganism of the fourth to the sixth aspect of the present invention, the temperature of metabolizing azo-system dyes is defined at 30 to 42° C.

The methods of textile printing by microorganism according to the fourth to the sixth aspect of the present invention are a method wherein on a part of the desirable pattern formed by coating a solution or paste solution containing the aforementioned bacterial strain is carried out using at least one of (1). a process of drawing a pattern under heating to a temperature above 50° C.; (2). a process of drawing a pattern with an alkali solution or paste, pH 9.0 or more or with an acid solution or paste, pH 4.0 or less; or (and) (3). a process of drawing a pattern with a disinfectant. Therefore, the textile printing is referred to as the so-called "reserve printing" . In other words, by drawing a pattern using a solution or paste inhibiting the bacterial proliferation (inhibiting the metabolism (metabolic reaction)), the decolorization of the part is prevented to maintain the coloring of an azo-system dye, thereby achieving textile printing.

The reason for healing above 50° C. as described above is that the reaction activity of the bacteria can be inhibited thereby. The heating means is not particularly limited. The types of the individual alkali components or acid components contained in the alkaline solution and the like and the acid solution and the like, are not limited. As the disinfectant (including sterilizing agents), use may be made of any of known various ones, for example, invert soap (trimethyldodecylammonium chloride and the, like), salts of heavy metals ($Ag^+$, $Hg^{2+}$), an aqueous 50 to 70% ethanol solution, a cresol solution or an aqueous sodium chloride solution of a high concentration above 20% by weight (wt %), etc.

By widely selecting the given temperature (which may be above 50° C. or below the temperature), and the pH (which may be above 9 or below 4 or a pH besides the ranges) and the type and concentration of the disinfectant, and additionally the processing time and the like, the microbial proliferation may be inhibited, nearly completely or incompletely. In the latter case, an ombre pattern (a pattern with different colors) may be produced, or by combination of the two, a further complex and beautiful pattern may be prepared.

A microorganism for decoloring azo-system dyes in accordance with an eighth aspect of the present invention, which may be used in the textile printing method of the fourth to the sixth aspect of the present invention, belongs to a bacterial strain Xanthomonas NR25-2 (Deposit No. FREM 13119) of genus Xanthomonas, which characteristically metabolizes the azo-system dyes and eliminates or decreases the coloring of the azo-system dyes. The microorganism for decoloring azo-system dyes can proliferate at 5 to 42° C.

A microorganism for decoloring azo-system dyes in accordance with a ninth aspect of the present invention, which may be used in the textile printing method of the fourth- to the sixth aspect of the present invention, belongs to a bacterial strain Achromobacter PR41-1 (Deposit No. FERM 13120) of genus Achromobacter, which characteristically metabolizes the azo-system dyes and eliminates or decreases the coloring of the azo-system dyes. The microorganism for decoloring azo-system dyes can proliferate at 10 to 42° C.

Because neither any reducing agent nor any alkali is used in accordance with the method of textile printing by microorganism of the present invention, the dye is less limited and the base material is less damaged, with less blurring in the border of colors, thereby producing a fine and complex pattern. In accordance with the present textile printing method, discharge printing with brilliant colors can he achieved, and furthermore, an ombre pattern (semi-discharge printing) can be produced freely and readily, by selecting the conditions for discharge printing. By further selecting the combination of the type of a dye contained in the bacterial solution and the type of a dye coloring cloth, a pattern of a degree of colorization and/or ombre dyeing meeting the objective can be produced. By carrying out the heating or the treatment with an alkali solution above pH 9.0, the activity of the microorganisms can be suppressed readily, for facilitating ready and secure reserve printing.

Using the microorganisms for decoloring azo-system dyes in accordance with the present invention, the coloring with the azo-system dyes can he eliminated or decreased readily and securely; using Bacillus OY1-2, in particular, the procedure may he safe with easy handling.

BIOLOGICAL DEPOSIT: Bacillus OY1-2 of genus Bacillus (Deposit No. FERM 13118) was deposited Aug. 20, 1992. The bacterial strain Xanthomonas NR25-2 (Deposit No. FERM 13119) of genus Xanthomonas which was deposited on Aug. 20, 1992. Bacterial strain Achromobacter PR41-1 (Deposit No. FERM 13120) of genus Achromobacter was deposited on Aug. 20, 1992. All three bacilli were deposited with the National Institute of Bioscience and Human-Technology Agency of Industrial Science and Technology. 1-3, Higashi 1 chome Tsukuba-Shi Idaraki-ken 305, JAPAN.

BRIEF DESCRIPTION OF THE DRAWINGS

The file of this patent contains at least one drawing executed in color. Copies of this patent with color drawings (s) will be provided by the Patent and Trademark Office upon request and payment of the necessary fee.

The FIGURE depicts the results of textile printing, carried out in Example 16, using a bacterial strain Bacillus OY1-2 of genus Bacillus, wherein the upper panel represents the results of the textile printing time of 24 hours; and the middle panel represents the results of the textile printing lime of 12 hours; and the lower panel represents the results of the results of the textile printing time of 6 hours.

DETAILED DESCRIPTION OF THE INVENTION

The "microorganism for decolorization of azo-system dye" of the seventh aspect, which is also used for the textile printing methods of the first to the third aspect, was isolated by the following method.

The collection site: Osaka Senko Co., Ltd., Sludge of dyeing waste water disposal.

The collection date: Sep. 22, 1990

The method for incubating and culturing the microorganism is as follows.

For specific description, three platinum loops of a sample was added into a test tube containing 2 ml of an enrichment culture medium for culture under shaking at 30° C.

Then, the discolored or decolored test tubes were periodically transferred on occasion. From the test tubes decolored or discolored even after the second periodic transfer, the culture media were mixed and diluted with the agar medium for general bacteria as described below (to which was added a dye at a ratio of 0.02%). Subsequently, the dye pigment was decolored on an agar plate, to isolate bacteria with "the halo" removed, which were designated as an isolated bacterial strain (which was defined as the bacterial strain "Bacillus OY1-2 of genus Bacillus"). As the dye, use was made of an azo-system dye, "Roccelline NS conc. 120%" (C. I. Acid Red 88), manufactured by Sumitomo Chemical Industry, Co. Ltd.

The composition of the enrichment culture medium was as follows;

| | |
|---|---|
| NaCl | 0.1% |
| $K_2HPO_4$ | 0.1% |
| $MgSO_4.7H_2O$ | 0.05% |
| $FeSO_4.7H_2O$ | 0.001% |
| $ZnSO_4.7H_2O$ | 0.0001% |
| $CuSO_4.7H_2O$ | 0.0001% |
| $MnSO_4.7H_2O$ | 0.0001% |
| $(NH_4)_2SO_4$ | 0.5% |

Dye (Roccelline NS conc. 120%) 0.02%.
Distilled water was used as the diluting water.

The "bacterial strain Bacillus OY1-2 of genus Bacillus" was deposited in Institute of Microorganism Industrial Technology, Agency of Industrial Science and Technology, and the Deposit Number was FERM 13118 (FERM P-13118). The scientific properties of the bacterium were as follows.

The bacterium is a bacillus of a morphological size of 0.6 to 0.8×3.0 to 5.0 $\mu$m, with motility and flagella, and the bacterium forms spores The bacterium is Gram positive, and grows in atmosphere and also under anaerobic conditions. The bacterium grows at a temperature of 20° C. to 50° C. The bacterium grows well at 38° C. The bacterium grows at pH 5 to 7. The bacterium does not grow at a sodium chloride content above 2%, but grows well below 2%.

The scientific properties and performance of the bacterium are shown below.

Gram staining; positive
Morphology; bacillus
Size; 0.6 to 0.8×3.0 to 5.0 $\mu$m
Spore shape; circular egg shape
Spore positioning; neutral, subend stand, end stand
Inflammation of bacterium; negative
Motility; positive
Atmospheric growth; positive
Anaerobic growth; positive
Catalase; positive
Oxidase; D
OF test; negative
Growth at 5° C.; negative
Growth at 10° C.; negative
Growth at 42° C.; positive
Growth at 50° C.; positive
Growth at 55° C.; negative
Growth at pHs 5 and 7; positive
Growth in 2% NaCl; positive
Growth in 5% NaCl; negative
Reduction of nitrate salt; positive
VP reaction; positive
Indole generation; negative
Urea decomposition: positive Utilization of citrate salt; positive
Starch hydrolysis; positive
Casein hydrolysis; positive
Gelatin hydrolysis; negative
Carbohydrate: acid
Glucose; positive
Mannitol; positive
Arabinose; negative
Xylose; negative
Gas (glucose) generation; negative.

The present inventors designated the bacterial strain as "Bacillus OY1-2". The azo-system dye decomposed by the present bacterium was a mixture of a variety of isomers, and the bacterium can metabolize all of the isomers. Because the bacterium has the activity at a relatively high temperature of 40 to 50° C., the time required for textile printing process can be shortened, and the contamination of contaminated bacteria can be prevented by killing such bacteria.

The "microorganism for decoloring azo-system dyes" of the eighth aspect, which is also used for the textile printing method of the fourth to the sixth aspect, was isolated by the following method.

The collection site: in soil at Oizumi Towel Plant
The collection date: May 12, 1990

The method for incubating and culturing the microorganism is as follows.

For specific description, three platinum loops of a sample was added into a test tube containing 2 ml of an enrichment culture medium for culture under shaking at 30° C. and then, the discolored or decolored test tubes were periodically transferred on occasion. From the test tubes decolored or discolored even after the second periodic transfer, the culture media were mixed and diluted with the agar medium for general bacteria as described below (to which was added a dye at a ratio of 0.02%). Subsequently, the dye pigment was decolored on an agar plate, to isolate bacteria with "the halo" removed, which was designated as an isolated bacterial strain (which was defined as the bacterial strain "Xanthomonas NR25-2 of genus Xanthomonas").

As the dye, use was made of an azo-system dye, "Brilliant Red 2B", manufactured by Sumitomo Chemical Industry, Co. Ltd.

The composition of the enrichment culture medium was as follows;

| | |
|---|---|
| NaCl | 0.1% |
| $K_2HPO_4$ | 0.1% |
| $MgSO_4.7H_2O$ | 0.05% |
| $FeSO_4.7H_2O$ | 0.001% |
| $ZnSO_4.7H_2O$ | 0.0001% |
| $CuSO_4.7H_2O$ | 0.0001% |
| $MnSO_4.7H_2O$ | 0.0001% |
| $(NH_4)_2SO_4$ | 0.5% |

Dye (the "Brilliant Red 2B") 0.02%
Distilled water was used as the diluting water.

The "bacterial strain Xanthomonas NR25-2 of genus Xanthomonas" was deposited in Institute of Microorganism Industrial Technology, Agency of Industrial Science and Technology, and the Deposit Number was FERM 13119 (FERM P-13119). The scientific properties of the bacterium were as follows.

The bacterium is a bacillus of a morphological size of 0.5×0.8 to 1.5 μm, with motility. The bacterium is Gram negative. The bacterium grows in atmosphere but does not grow under anaerobic conditions. The bacterium grows at a temperature of 5° C. to 42° C. The bacterium grows well at 38° C. The bacterium grows at pH 5 to 7. The bacterium grows well at a sodium chloride content below 5%.

The scientific properties and performance of the bacterium is shown below.

Gram staining; negative
Morphology; bacillus
Size; 0.5×0.8 to 1.5 μm
Motility; positive
Atmospheric growth; positive
Anaerobic growth; negative
Catalase; positive
Oxidase; negative
OF test; 0
Growth at 5° C.; positive
Growth at 10° C.; positive
Growth at 42° C.; positive
Growth at 50° C.; negative
Growth at 55° C.; negative
Growth at pHs 5 and 7; positive
Growth in 2% NaCl; positive
Growth in 5% NaCl; positive
Growth in the MacConky medium; positive
Pigment generation (King B); W positive
Reduction of nitrate salt; negative
VP reaction; negative
Indole generation; negative
$H_2S$ generation; negative
PNPG; positive
Urea decomposition: positive
Utilization of citrate salt; W positive
Utilization of gluconate; negative
Utilization of azipic acid; negative
Utilization of malic acid; positive
Utilization of capric acid; negative
Utilization of phenylacetate; negative
Alginin dihydrase; positive
Starch hydrolysis; negative
Casein hydrolysis; positive
Gelatin hydrolysis; negative
Esculin hydrolysis; positive
Carbohydrate: acid
Glucose; positive
Mannitol; negative
Arabinose; negative
Xylose; negative
Saccharose; negative
Mannose; positive
Maltose; positive
Gas (glucose) generation; negative.

The present inventors designated the bacterial strain as "Xanthomonas NR25-2". The azo dye decomposed by the present bacterium was a mixture of a variety of isomers, and the bacterium can metabolize all of the isomers.

The "microorganism for decoloring azo dyes" of the ninth aspect, which is also used for the textile printing method of the fourth to the sixth aspect, was isolated by the following method.

The collection site: in soil of the river bank of Otsu River
The collection date: Jun. 12, 1990

The method for incubating and culturing the microorganism is as follows.

For specific description, three platinum loops of a sample was added into a test tube containing 2 ml of an enrichment culture medium for culture under shaking at 30° C., and then, the discolored or decolored test tubes were periodically transferred on occasion. From the lest tubes decolored or discolored even after the second periodic transfer, the culture media were mixed and diluted with the agar medium for general bacteria as described below (to which was added a dye at a ratio of 0.02%). Subsequently, the dye pigment was decolored on an agar plate, to isolate bacteria with "the halo" removed, which was designated as an isolated bacterial strain (which was defined as the bacterial strain "Achromobactor PR41-1 of genus Achromobacter"). For the dye, use was made of an azo dye, "Brilliant Yellow 7 GL" , manufactured by Sumitomo Chemical Industry, Co., Ltd.

The composition of the enrichment culture medium was as follows;

| | |
|---|---|
| NaCl | 0.1% |
| $K_2HPO_4$ | 0.1% |
| $MgSO_4.7H_2O$ | 0.05% |
| $FeSO_4.7H_2O$ | 0.001% |
| $ZnSO_4.7H_2O$ | 0.0001% |
| $CuSO_4.7H_2O$ | 0.0001% |
| $MnSO_4.7H_2O$ | 0.0001% |
| $(NH_4)_2SO_4$ | 0.5% |

Dye (the "Brilliant Yellow 7GL") 0.02%.
Distilled water was used as the diluting water.

The "bacterial strain Achromobacter PR41-1 of genus Achromobacter" was deposited in Institute of Microorganism Industrial Technology, Agency of Industrial Science and Technology, and the Deposit Number was FERM 13120 (FERM P-13120). The scientific properties of the bacterium were as follows.

The bacterium is a bacillus of a morphological size of 0.5×1.0 to 1.5 μm, with no motility. The bacterium is Gram negative. The bacterium grows in atmosphere but does not grow under anaerobic conditions. The bacterium grows at a temperature of 10° C. to 42° C. The bacterium grows well at 38° C. The bacterium grows at pH 5 to 7. The bacterium does not grow at a sodium chloride content above 2%, but grows well at such content below 2%.

The scientific properties and performance of the bacterium is shown below.

Gram staining; negative
Morphology; bacillus
Size; 0.5×1.0 to 1.5 μm
Motility; negative
Atmospheric growth; positive
Anaerobic growth; negative
Catalase; negative
Oxidase; positive
OF test; 0
Growth at 5° C.; negative
Growth at 10° C.; positive
Growth at 42° C.; positive
Growth at 50° C.; negative
Growth at 55° C.; negative
Growth at pHs 5 and 7; positive
Growth in 2% NaCl; positive
Growth in 5% NaCl; negative
Growth in the MacConky medium; negative
Pigment generation (King B); negative
Reduction of nitrate salt; negative
VP reaction; negative
Indole generation; negative
$H_2S$ generation; negative
Urea decomposition: positive
Utilization of citrate salt; positive
Utilization of gluconate; positive
Utilization of azipic acid; negative
Utilization of malic acid; positive
Utilization of capric acid; positive
Utilization of phenylacetate; negative
Alginin dihydrase; negative
Starch hydrolysis; negative
Casein hydrolysis; negative
Gelatin hydrolysis; negative
Esculin hydrolysis; negative
Carbohydrate: acid
  Glucose; positive
  Mannitol; negative
  Arabinose; negative
  Xylose; negative
  Saccharose; negative
  Mannose; negative
  Maltose; negative
Gas (glucose) generation; negative.

The present inventors designated the bacterial strain as "Achromobacter PR41-1". The azo dye decomposed by the present bacterium was a mixture of a variety of isomers, and the bacterium can metabolize all of the isomers.

In accordance with the present invention, any base material may be satisfactory if it can be dyed with azo dyes and the like, generally including woven fabric (fiber material type, irrespective of the weaving type) and the like, but with no specific limitation. Non-woven fabric, paper and resin sheet may also be satisfactory.

The term "azo-system dye" of the present invention may be applicable to all of benzoazo-, naphthalene azo-, and heterocyclic azo dyes. The term "azo-system dye" may be applicable to all the of azo-system dyes classified in subject materials and functional groups, as shown in Table 1, irrespective of the types such as direct dyes, acid dyes, reaction dyes and dispersion dyes.

In accordance with the present invention, the method of coating on a given base material a solution containing a given bacterium (with no limitation as to whether or not a dye is contained therein; the solution may be a colored solution when it contains a dye), a paste containing a given bacterium and paste components (with no limitation as to whether or not a dye is contained there in; with no limitation as to the form of liquid or paste; the paste may be a colored paste if it contains a dye), may be any desired coating method, with no specific limitation, including for example, pattern printing method, ink jet method, hand writing method, roller printing method, screen printing method and the like. The paste is generally used for direct textile printing, containing the following paste components: starches (wheat starch, etc.), processed starches (British gum, etc.), processed natural gum (locust bean gum, etc.), sodium alginate, sodium carboxymethyl cellulose, synthetic paste materials (polyvinyl alcohol, polyvinyl acetate, etc.) and the like.

The three species of the aforementioned bacteria can decolor the coloring with azo compounds other than dyes, for example, azo pigments and the like. Other than for the textile printing, the bacteria can be used for the decoloring of the waste water colored with azo compounds.

PREFERRED EMBODIMENT OF THE PRESENT INVENTION

The present invention will now be explained in detail in examples and comparative examples.

I. Decoloring Lest with microorganism "Bacillus OY1-2"

(1) White discharge printing

EXAMPLE 1

Placing dry-type (normal) bouillon (200 ml; manufactured by NISSUI PARMACEUTICAL CO., LTD.) with addition of 0.02% of an azo dye ("Roccelline NS conc. 120%"; manufactured by SUMITOMO CHEMICAL CO. LTD.) into a 500-ml Sakaguchi flask, and inoculating therein the bacterial strain Bacillus OY1-2 for 48-hr stirring culture at 38° C., centrifuging the culture broth to collect the bacteria, followed by washing in 0.1 N phosphate buffer and centrifuging, the isolated bacteria (bacterial dispersion) was used, as it was, as a bacterial solution for discharge printing.

By using a direct azo dye "Kayarus Supra Red 6BL" (manufactured by NIPPON KAYAKU CO., LTD.) of a 3 wt % concentration, taffeta cloth of 100% rayon was dyed according to the routine method. The cloth was dyed in red color. On the cloth dyed in red color was placed a rubber plate, from which a star pattern was preliminarily cut out, and then, the bacterial solution for discharge printing was poured into the cut-out pattern. After removing the rubber plate, the cloth was kept wet and then placed in a thermostat at 30° C. for 24 hours for white discharge printing.

Consequently, the azo dye dyeing the cloth was completely metabolized, to produce a white star pattern on the red base. The cloth showed a brilliant pattern with no blurring in the border of the colors.

EXAMPLE 2

As in Example 1, white discharge printing was carried out in the present Example, except that (1) taffeta of 100% nylon was used as the cloth material; (2) an azo acid dye "Kayanol Milling Red BW" (manufactured by NIPPON KAYAKU CO., LTD.) of a 3 wt % concentration was used as the dye for dyeing the cloth (base color: red); (3) a rubber plate for charging a bacterial solution was used, from which a polka dot pattern was preliminarily cut out; and (4) the conditions for discharge printing were 40° C. and 16 hours.

Consequently, a white polka dot pattern was produced on the red base. Also in this case, a brilliant pattern was exhibited.

Because the azo acid dye "Kayanol Milling Red BW" has poor potential of discharge printing with a reducing agent, the dye is not used for general discharge printing. In the present Example, therefore, discharge printing could be carried out in a secure manner even if use was made of the azo acid dye which could not generally be used for discharge printing.

EXAMPLE 3

As in Example 1, white discharge printing was carried out in the present Example, except that (1) muslin of 100% wool was used as the cloth material; (2) an azo acid dye "Kayanol Milling Yellow 0" (manufactured by NIPPON KAYAKU CO., LTD.) of a 1 wt % concentration and an azo acid dye "Kayanol Milling Red RS 125" (manufactured by NIPPON KAYAKU CO., LTD.) of a 1 wt % concentration were used as the dyes for dyeing the cloth (base color: orange); (3) a rubber plate for charging a bacterial solution was used, from which a triangle pattern was preliminarily cut out; and (4) the conditions for discharge printing were 40° C. and 24 hours.

Consequently, the two types of the azo dyes dyeing the cloth were simultaneously metabolized, to produce a white triangle pattern on the orange base.

(2) Colored discharge printing

EXAMPLE 4

As in Example 1, colored discharge printing was carried out in the present Example, except that (1) broad cloth of 100% cotton was used as the cloth material; (2) an anthraquinone reaction dye "Mikasion Brilliant Blue RS" (manufactured by NIPPON KAYAKU CO., LTD.) of a 1 wt % concentration and an azo reaction dye "Remazol Red B 150" (manufactured by Mitsubishi Kasei Heochist Corporation) of a 1 wt % concentration were used as the dyes for dyeing the cloth (base color: purple); (3) a pattern was drawn on the dyed cloth by means of a brush, using the bacterial solution used in Example 1, and (4) the conditions for discharge printing were 40° C. and 12 hours.

Consequently, in the cotton cloth after the treatment, the azo dye coloring the cloth was metabolized, while the non-azo dye coloring the cloth remained unmetabolized, to prepare the pattern drawn on the purple base with the bacterial solution for discharge printing, into blue color (the color dyed with the anthraquinone dye). No blurring occurred in the border of the colors, to produce a brilliant pattern.

EXAMPLE 5

As in Example 1, colored discharge printing was carried out in the present Example, except that (1) muslin of 100% wool was used as the cloth material; (2) an anthraquinone acid dye "Alizarine Rubinol 3G 115%" (manufactured by Yamada Chemical Industry Co. Ltd.) of a 1 wt % concentration and an azo acid dye "Kayanol Navy Blue R" (manufactured by NIPPON KAYAKU CO., LTD.) of a 1 wt % concentration were used as the dyes for dyeing the cloth; (3) a rubber plate for charging a bacterial solution was used, from which a polka dot pattern was preliminarily cut out; and (4) the conditions for discharge printing were 50° C. and 12 hours.

Consequently, in the 100% wool cloth after the treatment, the azo dye dyeing the cloth was highly metabolized at 50° C. for a short period of lime, while the non-azo dye was left unmetabolized, to produce a red polka dot pattern on the purple base. Also in this case, a brilliant pattern was exhibited.

EXAMPLE 6

As in Example 1, colored discharge printing was carried out in the present Example, except that (1) plain-woven fabric of 100% diacetate was used as the cloth material; (2) an azo dispersion dye "Kayalon Fast Yellow G" (manufactured by NIPPON KAYAKU CO., LTD.) of a 3 wt % concentration and an azo dispersion dye "Kayalon Fast Rubine B" (manufactured by NIPPON KAYAKU CO., LTD.) of a 3 wt % concentration and an anthraquinone dispersion dye "Kayalon Fast Blue FN" (manufactured by Nippon Chemical Pharmaceutical Co Ltd.) of a 3 wt % concentration were used as the dyes for dyeing the cloth (base color: black); (3) a rubber plate for charging a bacterial solution was used, from which a triangle pattern was preliminarily cut out; and (4) the conditions for discharge printing were 40° C. and 24 hours.

Consequently, the two types of the azo dyes dyeing the cloth were simultaneously metabolized, while keeping the non-azo dye unmetabolized as it was, to produce a blue triangle pattern on the black base. Also in this case, a brilliant pattern was exhibited.

EXAMPLE 7

As in Example 1, colored discharge printing was carried out in the present Example, except that (1) as the bacterial solution, use was made of a colored discharge printing solution produced by adding an azo acid dye "Kayanol Milling Yellow 3GW" (manufactured by Nippon Chemical Pharmaceutical Co, Ltd.) at 4 wt % to the bacterial solution used in Example 1; (2) wool was used as the cloth material; (3) an anthraquinone acid dye "Alizarine Rubinol 3G 115% (manufactured by Yamada Chemical Industry Co., Ltd.) and an azo acid dye "Kayanol Navy Blue R" (manufactured by NIPPON KAYAKU CO., LTD.) were used as the dyes for dyeing the cloth (base color: purple); (4) a steaming process was carried out at 100° C. for 60 minutes after discharge printing, followed by washing in water and washing in warm water.

Consequently, the azo dye in the bacterial solution and the azo dye dyeing the cloth were nearly metabolized, while keeping the non-azo dye dyeing the cloth unmetabolized as it was, to produce a given pattern of approximately red color on the purple base.

EXAMPLE 8

As in Example 7, colored discharge printing was carried out in the present Example, except that (1) as the bacterial solution, use was made of a colored discharge printing solution produced by adding an azo acid dye Kayanol Navy Blue R" (manufactured by NIPPON KAYAKU CO., LTD.) and an anthraquinone acid dye "Alizarine Rubinol 3G 115%" (manufactured by Yamada Chemical Industry Co., Ltd.), individually at 2 wt %, to the bacterial solution used in Example 1; (2) wool was used as the cloth material; (3) an azo acid dye "Kayanol Navy Blue R" (manufactured by NIPPON KAYAKU CO., LTD.) was used as the dye for dyeing the cloth (base color: blue).

Consequently, the azo dye in the bacterial solution and the azo dye dyeing the cloth were nearly metabolized, while keeping the non-azo dye in the bacterial solution unmetabolized as it was, to produce a given pattern of red to red purple color on the blue base.

EXAMPLE 9

As in Example 7, colored discharge printing was carried out in the present Example, except that (1) as the bacterial solution, use was made of a colored discharge printing solution produced by adding an anthraquinone acid dye "Suminol Fast Blue G" (manufactured by SUMITOMO CHEMICAL CO., LTD.) at 3 wt % to the bacterial solution used in Example 1; (2) wool was used as the cloth material; and (3) an azo acid dye "Kayanol Milling Yellow 0" (manufactured by NIPPON KAYAKU CO. LTD.) of 2 wt % and an azo acid dye "Kayanol Milling Red RS 125" ((manufactured by NIPPON KAYAKU CO., LTD.) of 2 wt % were used as the dyes for dyeing the cloth (base color: orange).

Consequently, the two types of the azo dyes dyeing the cloth were nearly metabolized, while keeping the non-azo dye in the bacterial solution unmetabolized as it was, to produce a given pattern in blue on the orange base.

EXAMPLE 10

As in Example 7, colored discharge printing was carried out in the present Example, except that (1) as the bacterial solution, use was made of a colored discharge printing solution produced by adding an anthraquinone dispersion dye "Diacelliton Fast Pink R" (manufactured by Mitsubishi Kasei Heochist Corporation) at 3 wt % to the bacterial solution used in Example 1; (2) plain-woven fabric of 100% diacetate was used as the cloth material; (3) use was made of as the dyes for dyeing the cloth an azo dispersion dye "Kayalon Fast Yellow G" (manufactured by NIPPON KAYAKU CO., LTD.) of 1 wt %, an azo dispersion dye "Kayalon Fast Rubine B" (manufactured by NIPPON KAYAKU CO., LTD.) of 1 wt % and an anthraquinone dispersion dye "Suminol Fast Blue G" (manufactured by SUMITOMO CHEMICAL CO., LTD.) (base color: black); and (4) the conditions for steaming process were 100° C. and 30 minutes.

Consequently, the two types of the azo dyes dyeing the cloth were metabolized while the two types of the non-azo dyes in the bacterial solution and on the dyed cloth were kept unmetabolized as they were, to produce a given pattern of pale purple on the black base.

EXAMPLE 11

As in Example 7, colored discharge printing was carried out in the present Example, except that (1) as the bacterial solutions, use was made of Solution A produced by adding a non-azo reaction dye (an anthraquinone reaction dye) "Mikacion Brilliant Blue RS" (manufactured by NIPPON KAYAKU CO., LTD.) at 3 wt % to the bacterial solution used in the Example 1, and Solution B produced by adding the same reaction dye at 0.1 wt % to the bacterial solution; (2) cotton was used as the cloth material; (3) use was made of as the dye for dyeing the cloth a 2 wt % azo reaction dye "Remazol Red B150" (manufactured by Mitsubishi Kasei Heochist Corporation) to dye the cloth in red color; (4) an individually given pattern was drawn by using (either one of) the two types of the solutions, i.e. the Solution A and B; (5) the conditions for discharge printing were 40° C. and 12 hours and (6) the post-treatment conditions comprised immersing the cloth in an alkali solution (at 90° C.) for 15 seconds prior to washing in water, immersing then the resulting cloth in an aqueous 5 wt % acetic acid solution for 15 seconds prior to neutralization, and washing the cloth in warm water and then in water.

Consequently, the non-azo dyes of different concentrations in the bacterial solutions remained as they were, to produce the given pattern in two colors, namely dark blue and pale blue, on the red base.

The composition of the alkali solution described above was as follows. (The term "%" means "% by weight" hereinafter).

Anhydrous mirabilite; 10%, Sodium carbonate; 15%, Potassium carbonate; 5%, Sodium hydroxide; 2%, Sodium silicate; 1%, Water; 67% (total 100%).

On the broad cloth of 100% cotton which was preliminarily dyed using an azo reaction dye "Remazol/Diamira Brill. Red 5B" (manufactured by Mitsubishi Kasei Heochist Corporation) of a 3 wt % concentration according to the routine method, was placed a rubber plate, from which a polka dot pattern was preliminarily cut out. Then, the following colored discharge printing paste was printed in the part of the cut-out pattern. After drying, the cloth was steamed at 100° C. for 10 minutes, followed by an over-heated steam process at 170° C. for 7 minutes prior to washing in water, and the cloth was then subjected to an oxidation process under the conditions of 5 g/liter sodium perborate, a bath ratio of 1:40, and 50° C. for 10 minutes, followed by washing and drying.

[Composition of the colored discharge printing paste] (The term "%" means "% by weight" hereinbelow.)

A thren dye, "Mikethren Brilliant Blue R" (manufactured by Mitsui Toatsu Chemicals, Inc.), 3%; Rongalito C, 12%; potassium carbonate, 7%; aqueous 35% naphka crystal gum, 60%; glycerin, 3%; water, 15% (total 100%).

Consequently, a blue polka dot pattern was produced on the red base. In this case, equipment for steaming process is needed, and furthermore, a variety of chemicals should be required, involving further complex procedures.

(3) Direct textile printing

EXAMPLE 12

In the present Example, as a colored discharge printing paste, use was made of a paste produced by adding an azo direct dye "Kayarus Supra Yellow RL" (manufactured by NIPPON KAYAKU CO., LTD.) at 4 wt % and a copper phthalocyanine direct dye "Sumilight Supra Turquoise Blue G conc." (manufactured by SUMITOMO CHEMICAL CO., LTD.) at 4 wt % and British Gum at 10 wt % (qts. water) to the bacterial solution used in the Example 1, followed by kneading them together. Alternatively, dyeing habutae cloth of rayon 100 % using an azo direct dye "Kayarus Supra Red 6BL" (manufactured by NIPPON KAYAKU CO., LTD.) of a 3 wt % concentration according to the routine method, the cloth was dyed in red. A pattern was drawn on the habutae of 100 % rayon dyed in red, using the colored discharge printing paste squeezed from the tube. In the wet state, the cloth was put in a thermostat at 30° C. for 18 hours, and then after taking the cloth out of the thermostat, the cloth was subjected to steam processing at 100° C. at ambient pressure for 40 minutes, followed by washing in water and then in warm water.

Consequently, the two types of the azo dyes in the paste and the dyed cloth were nearly metabolized (a certain degree of the azo dye in the paste remained. ). Concurrently, the non-azo dye in the paste remained unmetabolized, to produce a pattern in blue green or in green blue on the red base.

(4) With respect to the degree of discharge printing

EXAMPLE 13

As in Example 1, testing was carried out, except that (1) use was made of the bacterial solution used in the Example 1: (2) two types of cloths, namely rayon or cotton, were used for individual dyeing with an azo direct dye "Kayarus Supra Yellow RL" (manufactured by NIPPON KAYAKU CO. LTD.) (base color: yellow); and (3) the discharge printing conditions were 40° C. and 36 hours.

Consequently, in the case of the cotton, the coloring with the azo dye was completely decolored, while in the case of the rayon, the coloring got pale but was not completely decolored. In the case of the rayon, furthermore, the same process was carried out at the same temperature over 72 hours, so that the coloring was nearly completely decolored. Thus, it is indicated that the coloring of the azo dye was decolored or decreased, depending on the conditions. Simultaneously, it is also indicated that the decoloring degree varies depending on the type of the cloth and the metabolizing temperature.

EXAMPLE 14

As in Example 1, semi-colored discharge printing was carried out, except that (1) use was made of a colored discharge printing solution produced by adding an azo direct dye "Kayarus Supra Yellow RL" (manufactured by NIPPON KAYAKU CO., LTD.) at 3 wt % to the bacterial solution used in the Example 1; (2) rayon was used as the cloth material; (3) as the dye for dyeing the cloth, use was made of a 3 wt % anthraquinone reaction dye "Mikacion Brilliant Blue RS" (manufactured by NIPPON KAYAKU CO., LTD.) (base color: blue) and (4) the conditions for discharge printing were 40° C. and 12 hours.

Consequently, not the whole azo direct dye was metabolized, but some of the dye remained, to produce a blue pattern tinted with green on the blue base. As has been described above, semi-discharge printing was effected using such rayon material under the discharge printing conditions, so that ombre dyeing could be achieved.

EXAMPLE 15

As in Example 12, direct discharge printing was carried out, except that (1) as the colored discharge printing solution, use was made of Paste A (green) produced by adding a copper phthalocyanine direct dye "Sumilight Supra Turquoise Blue G conc." (manufactured by SUMITOMO CHEMICAL CO., LTD.) at 4 w t %, an azo direct dye "Kayarus Supra Yellow RL" (manufactured by Nippon Kayaku Co., Ltd.) at 4 wt % and British Gum at 10 wt % (qts. water) to the bacterial solution used in the Example 1, and Paste B containing all of them excluding only the azo direct dye"Kayarus Supra Yellow RL"; (2) habutae of rayon 100% was used as the cloth material, which was not dyed; (3) an individually given pattern was drawn on the cloth, independently using the two types of the Pastes (Pastes A and B).

Consequently, under the discharge printing conditions, a part of the azo dye in the Paste A was metabolized. Because no metabolizable azo dye was contained in the paste B, however, two types of patterns in blue tinted with green (partially metabolized portions) and in blue were produced on the white base

EXAMPLE 16

As in Example 1, discharge printing process was carried out, except that (1) use was made of an azo direct dye "Kayarus Supra Red 6BL" (manufactured by NIPPON KAYAKU CO., LTD.) of a 2 wt % concentration as the dye for dyeing cloth (base color, red); (2) the, discharge printing conditions were 40° C. and 6 hours, 12 hours or 24 hours.

The results are shown in the FIGURE. The FIGURE depicts a duck and bear which represent the pattern part, while the red area represents the base color. In the FIGURE, furthermore, the upper panel depicts the results of 24 hours of discharge printing time; the middle panel depicts the results of 12 hours of discharge printing time; and the lower panel depicts the results of 6 hours of discharge printing time. According to the results, white discharge printing was effected for 24 hours; and as the reaction lime got shorter such as 12 hours and 6 hours, the degree of discharge printing got smaller, increasing sequentially the redness to effect semi-discharge printing (namely, preparation of ombre pattern). Additionally, the yellow color in the FIG- URE depicts the original pale yellow color (not white) of the cloth, which color developed after decoloring: The red color, the dye color, was almost completely eliminated. Thus, the degree of "ombre dyeing" can be modified freely, by selecting the reaction conditions.

(5) Advantages of Examples

As apparently shown in the metabolism of any of all the various azo dyes (reaction dyes, direct dyes, acid dyes and dispersion dyes) and non-metabolism of the non-azo dyes (anthraquinone reaction dyes, anthraquinone acid dyes, anthraquinone dispersion dyes and copper phthalocyanine direct dye), the bacterial strain has excellent selectivity and wide applications to the metabolizable azo dyes.

Additionally, various azo dyes in the bacterial solution and various azo dyes dyeing cloth were metabolized. Furthermore, various azo dyes coloring a variety of base materials were also metabolized, although its metabolic degree varied. Therefore, by selecting the combination of a type of a dye (notwithstanding the type of the dye whether it is an azo dye or a non-azo dye) in the bacterial solution and the like and a type of a dye coloring the cloth (notwithstanding the type of the dye whether it is an azo dye or a non-azo dye), or by simultaneously carrying out a plurality of the combinations, a pattern of a color and/or ombre dyeing satisfying the objective can be produced freely.

By changing the type of a base material, the metabolizing temperature and the metabolizing time, the degree of discharge printing can be modified (semi-discharge printing can be effected freely). Thus, a pattern such as "ombre" and the like can be produced freely.

Because discharge printing can be done at a relatively high temperature of 30 to 50° C. and particularly because most of contaminated bacteria are killed at a temperature of about 40 to 50° C., the present invention is preferable from the respect of hygienic health. Furthermore, because the "Bacillus OY1-2" belongs to genus Bacillus, the bacterial strain is so stable that the strain can be used easily, and the strain can satisfactorily resist the variation of discharge printing conditions. Still furthermore, because the strain can grow under anaerobic conditions, the strain is very useful.

II. Decoloring lest with microorganism "Xanthomonas NR25-2"

(1) White discharge printing

EXAMPLE 1

Placing dry-type (normal) bouillon (200 ml; manufactured by NISSUI PARMACEUTICAL CO., LTD.) with addition of 0.02% of an azo dye ("Brilliant Red 2B"; manufactured by SUMITOMO CHEMICAL COMPANY LIMITED) into a 500-ml Sakaguchi flask, and inoculating therein the bacterial strain Xanthomonas NR25-2 for 48 hrs stirring culture at 38° C., centrifuging the culture broth to collect the bacteria, followed by washing in 0.1 N phosphate buffer and centrifuging, the isolated bacteria (bacterial dispersion) was used, as it was, as a bacterial solution for discharge printing.

By using a direct azo dye "Kayarus Supra Red 6BL" (manufactured by NIPPON KAYAKU CO., LTD.) of a 3 wt % concentration, taffeta cloth of 100% rayon was dyed according to the routine method. The cloth was dyed in red color. On the cloth dyed in red color was placed a rubber plate, from which a star pattern was preliminarily cut out, and then, the bacterial solution for discharge printing was poured into the cut-out pattern. After removing the rubber plate, the cloth was kept wet and then placed in a thermostat at 30° C. for 24 hrs for white discharge printing.

Consequently, the azo dye dyeing the cloth was completely metabolized, to produce a white star pattern on the red base. The cloth showed a brilliant pattern with no blurring in the border of the colors.

EXAMPLE 2

As in Example 1, white discharge printing was carried out in the present Example, except that (1) taffeta of 100% nylon was used as the cloth material; (2) an azo acid dye "Kayanol Milling Red BW" (manufactured by NIPPON KAYAKU CO., LTD.) of a 3 wt % concentration was used as the dye for dyeing the cloth (base color: red); (3) a rubber plate for charging a bacterial solution was used, from which a polka dot pattern was preliminarily cut out; and (4) the conditions for discharge printing were 40° C. and 16 hours.

Consequently, a white polka dot pattern was produced on the red base. Also in this case, a brilliant pattern was exhibited.

Because the azo acid dye "Kayanol Milling Red BW" has poor potential of discharge printing with a reducing agent, the dye is not used for general discharge printing. In the present Example, therefore, discharge printing could be carried out in a secure manner even if use was made of the azo acid dye which could not generally be used for discharge printing.

EXAMPLE 3

As in Example 1, white discharge printing was carried out in the present Example, except that (1) muslin of 100% wool was used as the cloth material; (2) an azo acid dye "Kayanol Milling Yellow 0" (manufactured by NIPPON KAYAKU CO., LTD.) of a 1 wt % concentration and an azo acid dye "Kayanol Milling Red RS 125" (manufactured by NIPPON KAYAKU CO., LTD.) of a 1 wt % concentration were used as the dyes for dyeing the cloth (base color: orange); (3) a rubber plate for charging a bacterial solution was used, from which a triangle pattern was preliminarily cut out; and (4) the conditions for discharge printing were 40° C. and 24 hours.

Consequently, the two types of the azo dyes dyeing the cloth were simultaneously metabolized, to produce a white triangle pattern on the orange base.

(2) Colored discharge printing

EXAMPLE 4

As in Example 1, colored discharge printing was carried out in the present Example, except that (1) broad cloth of 100% cotton was used as the cloth material; (2) an anthraquinone reaction dye "Mikasion Brilliant Blue RS" (manufactured by NIPPON KAYAKU CO., LTD.) of a 1 wt % concentration and an azo reaction dye "Remazol Red B 150" (manufactured by Mitsubishi Kasei Heochist Corporation) of a 1 wt % concentration were used as the dyes for dyeing the cloth (base color: purple); (3) a pattern was drawn on the dyed cloth by means of a brush, using the bacterial solution used in Example 1, and (4) the conditions for discharge printing were 40° C. and 12 hours.

Consequently, in the cotton cloth after the treatment, the azo dye coloring the cloth was metabolized, while the non-azo dye coloring the cloth remained unmetabolized, to prepare the pattern drawn on the purple base with the bacterial solution for discharge printing, into blue color (the color dyed with the anthraquinone dye). No blurring occurred in the border of the colors, to produce a brilliant pattern.

EXAMPLE 5

As in Example 1, colored discharge printing was carried out in the present Example, except that (1) muslin of 100% wool was used as the cloth material; (2) an anthraquinone acid dye "Alizarine Rubinol 3G 115%" (manufactured by Yamada Chemical Industry Co. Ltd.) of a 1 wt % concentration and an azo acid dye "Kayanol Navy Blue R" (manufactured by NIPPON KAYAKU CO., LTD.) of a 1 wt % concentration were used as the dyes for dyeing the cloth (base color: purple); (3) a rubber plate for charging a bacterial solution was used, from which a polka dot pattern was preliminarily cut out; and (4) the conditions for discharge printing were 40° C. and 12 hours.

Consequently, in the 100% wool cloth after the treatment, the azo dye dyeing the cloth was highly metabolized at 50° C. for a short period of time, while the non-azo dye was remained unmetabolized, to produce a red polka dot pattern on the purple base. Also in this case, a brilliant pattern was exhibited.

EXAMPLE 6

As in Example 1, colored discharge printing was carried out in the present Example, except that (1) plain-woven fabric of 100% diacetate was used as the cloth material; (2) an azo dispersion dye "Kayalon Fast Yellow G" (manufactured by NIPPON KAYAKU CO., LTD.) of a 3 wt % concentration and an azo dispersion dye "Kayalon Fast Rubine B" (manufactured by NIPPON KAYAKU CO., LTD.) of a 3 wt % concentration and an anthraquinone dispersion dye "Kayalon Fast Blue FN" (manufactured by Nippon Chemical Pharmaceutical Co., Ltd.) of a 3 wt % concentration were used as the dyes for dyeing the cloth (base color: black); (3) a rubber plate for charging a bacterial solution was used, from which a triangle pattern was preliminarily cut out; and (4) the conditions for discharge printing were 40° C. and 24 hours.

Consequently, the two types of the azo dyes dyeing the cloth were simultaneously metabolized, while keeping the non-azo dye unmetabolized as it was, to produce a blue triangle pattern on the black base. Also in this case, a brilliant pattern was exhibited.

EXAMPLE 7

As in Example 1, colored discharge printing was carried out in the present Example, except that (1) as the bacterial solution, use was made of a colored discharge printing solution produced by adding an azo acid dye "Kayanol Milling Yellow 3GW" (manufactured by NIPPON KAYAKU CO., LTD.) at 4 wt % to the bacterial solution used in Example 1; (2) wool was used as the cloth material; (3) an anthraquinone acid dye "Alizarine Rubinol 3 G 115% (manufactured by Yamada Chemical Industry Co., Ltd.) and an azo acid dye "Kayanol Navy Blue R" (manufactured by NIPPON KAYAKU CO., LTD.) were used as the dyes for dyeing the cloth (base color: purple); and (4) a steaming process was carried out at 100° C. for 60 minutes after discharge printing, followed by washing in water and washing in warm water.

Consequently, the azo dye in the bacterial solution and the azo dye dyeing the cloth were nearly metabolized, while keeping the non-azo dye dyeing the cloth unmetabolized as it was, to produce a given pattern of approximately red color on the purple base.

EXAMPLE 8

As in Example 7, colored discharge printing was carried out in the present Example, except that (1) as the bacterial solution, use was made of a colored discharge printing solution produced by adding an azo acid dye "Kayanol Navy Blue R" (manufactured by NIPPON KAYAKU CO., LTD.) and an anthraquinone acid dye "Alizarine Rubinol 3G 115%" (manufactured by Yamada Chemical Industry Co., Ltd.), individually at 2 wt %, to the bacterial solution used in Example 1; (2) wool was used as the cloth material; (3) an azo acid dye "Kayanol Navy Blue R" (manufactured by NIPPON KAYAKU CO., LTD.) was used as the dye for dyeing the cloth (base color: blue).

Consequently, the azo dye in the bacterial solution and the azo dye dyeing the cloth were nearly metabolized, while keeping the non-azo dye in the bacterial solution unmetabolized as it was, to produce a given pattern of red to red purple color on the blue base.

EXAMPLE 9

As in Example 7, colored discharge printing was carried out in the present Example, except that (1) as the bacterial solution, use was made of a colored discharge printing solution produced by adding an anthraquinone acid dye "Suminol Fast Blue G" (manufactured by SUMITOMO CHEMICAL CO., LTD.) at 2 wt % to the bacterial solution used in Example 1; (2) wool was used as the cloth material; and (3) an azo acid dye "Kayanol Milling Yellow 0" (manufactured by NIPPON KAYAKU CO., LTD.) of 2 wt % and an azo acid dye "Kayanol Milling Red RS 125" (manufactured by NIPPON KAYAKU CO., LTD.) of 2 wt % were used as the dyes for dyeing the cloth (base color: orange).

Consequently, the two types of the azo dyes dyeing the cloth were metabolized, while keeping the non-azo dye in the bacterial solution unmetabolized as it was, to produce a given pattern in blue on the orange base.

EXAMPLE 10

As in Example 7, colored discharge printing was carried out in the present Example, except that (1) as the bacterial solution, use was made of a colored discharge printing solution produced by adding an anthraquinone dispersion dye "Diacelliton Fast Pink R" (manufactured by Mitsubishi Kasei Heochist Corporation) at 3 wt % to the bacterial solution used in Example 1; (2) plain-woven fabric of 100% diacetate was used as the cloth material; (3) use was made of as the dyes for dyeing the cloth an azo dispersion dye "Kayalon Fast Yellow G" (manufactured by NIPPON KAYAKU CO., LTD.) of 1 wt %, an azo dispersion dye "Kayalon Fast Rubinol B" (manufactured by NIPPON KAYAKU CO. LTD.) of 1 wt % and an anthraquinone dispersion dye "Kayalon Fast Blue FN" (manufactured by NIPPON KAYAKU CO., LTD.) (base color: black); and (3) the conditions for steaming process were 100° C. and 30 minutes.

Consequently, the two types of the azo dyes dyeing the cloth were metabolized while the two types of the non-azo dyes in the bacterial solution and on the dyed cloth were kept unmetabolized as they were, to produce a given pattern of pale purple on the black base.

EXAMPLE 11

As in Example 7, colored discharge printing was carried out in the present Example, except that (1) as the bacterial solutions, use was made of Solution A produced by adding a non-azo reaction dye (an anthraquinone reaction dye) "Mikacion Brilliant Blue RS" (manufactured by NIPPON KAYAKU CO., LTD.) at 3 wt % to the bacterial solution used in the Example 1, and Solution B produced by adding the same reaction dye at 0.1 wt % to the bacterial solution; (2) cotton was used as the cloth material; (3) use was made of as the dye for dyeing the cloth a 2 wt % azo reaction dye "Remazol Red B150" (manufactured by Mitsubishi Kasei Heochist Corporation) to dye the cloth in red color; (4) an individually given pattern was drawn by using (either one of) the two types of the solutions, i.e. the Solution A and B; (5) the conditions for discharge printing were 40° C. and 12 hours and (6). The post-treatment conditions comprised immersing the cloth in an alkali solution (at 90° C.) for 15 seconds prior to washing in water, immersing then the resulting cloth in an aqueous 5 wt % acetic acid solution for 15 seconds prior to neutralization, and washing the cloth in warm water and then in water.

Consequently, the non-azo dyes of different concentrations in the bacterial solutions remained as they were, to produce the given pattern in two colors, namely dark blue and pale blue, on the red base.

The composition of the alkali solution described above was as follows. (The term "%" means "% by weight" hereinafter).

Anhydrous mirabilite; 10%, Sodium carbonate; 15% Potassium carbonate; 5% Sodium hydroxide; 2% Sodium silicate; 1% Water; 67% (total 100%).

COMPARATIVE EXAMPLE

On the broad cloth of 100% cotton which was preliminarily dyed using an azo reaction dye "Remazol/Diamira Brill. Red 5B" (manufactured by Mitsubishi Kasei Heochist Corporation) of a 3 wt % concentration according to the routine method, was placed a rubber plate, from which a polka dot pattern was preliminarily cut out. Then, the following colored discharge printing paste was printed in the part of the cut-out pattern. After drying, the cloth was steamed at 100° C. for 10 minutes, followed by an overheated steam process at 170° C. for 7 minutes prior to washing in water, and the cloth was then subjected to an oxidation process under the conditions of 5g/liter sodium perborate, a bath ratio of 1:40, and 50° C. for 10 minutes, followed by washing and drying.

Composition of the colored discharge printing paste (The term "%" means "% by weight" hereinbelow.)

A thren dye "Mikethren Brilliant Blue R" (manufactured by Mitsui Toatsu Dyes, Inc.), 3%; Rongalito C, 12%; potassium carbonate, 7%; aqueous 35% naphka crystal gum, 60%; glycerin, 3%; water, 15% (total 100%).

Consequently, a blue polka dot pattern was produced on the red base. In this case, equipment for steaming process is needed, and furthermore, a variety of chemicals should be required, involving further complex procedures.

(3) Direct textile printing

EXAMPLE 12

In the present Example, as a colored discharge printing paste, use was made of a paste produced by adding an azo direct dye "Kayarus Supra Yellow RL" (manufactured by NIPPON KAYAKU CO., LTD.) at 4 wt % and a copper phthalocyanine direct dye "Sumilight Supra Turquoise Blue G conc." (manufactured by SUMITOMO CHEMICAL CO., LTD.) at 4 wt % and British Gum at 10 wt % (qts. water) to the bacterial solution used in the Example 1, followed by kneading them together. Alternatively, dyeing habutae cloth of rayon 100% using an azo direct dye "Kayarus Supra Red 6BL" (manufactured by NIPPON KAYAKU CO., LTD.) of a 3 wt % concentration according to the routine method, the cloth was dyed in red. A pattern was drawn on the habutae of 100% rayon dyed in red, using the colored discharge printing paste squeezed from the tube. In the wet state, the cloth was put in a thermostat at 30° C. for 18 hours, and then after taking the cloth out of the thermostat, the cloth was subjected to steam processing at 100° C. at ambient pressure for 40 minutes, followed by washing in water and then in warm water.

Consequently, the two types of the azo dyes in the paste and the dyed cloth were nearly metabolized (a certain degree of the azo dye in the paste remained.). Concurrently, the non-azo dye in the paste remained unmetabolized, to produce a pattern in dim green blue on the red base.

(4) With respect to the degree of discharge printing

EXAMPLE 13

As in Example 1, testing was carried out, except that (1) use was made of the bacterial solution used in the Example 1; (2) two types of cloths, namely rayon or cotton, were used for individual dyeing with an azo direct dye "Kayarus Supra Yellow RL" (manufactured by NIPPON KAYAKU CO., LTD.) (base color: yellow); and (3) the discharge printing conditions were 40° C. and 36 hours.

Consequently, in the case of the cotton, the coloring with the azo dye was completely decolored, while in the case of the rayon, the coloring got pale but was not completely decolored. In the case of the rayon, furthermore, the same process was carried out at the same temperature over 72 hours, so that the coloring was nearly completely decolored. Thus, it is indicated that the coloring of the azo dye was decolored or decreased, depending on the conditions. Simultaneously, it is also indicated that the decoloring degree varies depending on the type of the cloth and the metabolizing temperature.

EXAMPLE 14

As in Example 1, semi-colored discharge printing was carried out, except that (1) use was made of a colored discharge printing solution produced by adding an azo direct dye "Kayarus Supra Yellow RL" (manufactured by NIPPON KAYAKU CO., LTD.) at 3 wt % to the bacterial solution used in the Example 1; (2) rayon was used as the cloth material; (3) as the dye for dyeing the cloth, use was made of a 3 wt % anthraquinone reaction dye "Mikacion Brilliant Blue RS" (manufactured by NIPPON KAYAKU CO., LTD.) (base color: blue) and (4) the conditions for discharge printing were 40° C. and 12 hours.

Consequently, not the whole azo direct dye was metabolized, but some of the dye remained, to produce a blue pattern tinted with green on the blue base. As has been described above, semi-discharge printing was effected using such rayon material under the discharge printing conditions, so that ombre dyeing could be achieved.

EXAMPLE 15

As in Example 12, direct discharge printing was carried out, except that (1) as the colored discharge printing solution, use was made of Paste A (green) produced by adding a copper phthalocyanine direct dye "Sumilight Supra Turquoise Blue G conc." (manufactured by SUMITOMO CHEMICAL CO., LTD.) at 4 wt %, an azo direct dye "Kayarus Supra Yellow RL" (manufactured by NIPPON KAYAKU CO. LTD.) at 4 wt % and British Gum at 10 wt % (qts. water) to the bacterial solution used in the Example 1, and Paste B containing all of them excluding only the azo direct dye "Kayarus Supra Yellow RL" (manufactured by NIPPON KAYAKU CO. LTD.); (2) habutae of rayon 100% was used as the cloth material, which was not dyed; and (3) an individually given pattern was drawn on the cloth, independently using the two types of the Pastes (Pastes A and B).

Consequently, under the discharge printing conditions, a part of the azo dye in the Paste A was metabolized. Because no metabolizable azo dye was contained in the paste B, however, two types of patterns in blue tinted with green (partially metabolized portions) and in blue were produced on the white base.

EXAMPLE 16

As in Example 1, discharge printing process was carried out, except that (1) use was made of an azo direct dye "Kayarus Supra Red 6BL" (manufactured by NIPPON KAYAKU CO. LTD.) of a 2 wt % concentration as the dye for dyeing cloth (base color, red); (2) the discharge printing conditions were 40° C. and 6 hours, 12 hours or 24 hours.

(5) Advantages of Examples

As apparently shown in the metabolism of any of all the various azo dyes (reaction dyes, direct dyes, acid dyes and dispersion dyes) and non-metabolism of the non-azo dyes (anthraquinone reaction dyes, anthraquinone acid dyes, anthraquinone dispersion dyes and copper phthalocyanine direct dyes), the bacterial strain has excellent selectivity and wide applications to the metabolizable azo dyes.

Additionally, various azo dyes In the bacterial solution and various azo dyes dyeing cloth were metabolized. furthermore, various azo dyes coloring a variety of base materials were also metabolized, although its metabolic degree varied. Therefore, by selecting the combination of a type of a dye (notwithstanding the type of the dye (whether it is an azo dye or a non-azo dye) in the bacterial solution and the like and a type of a dye coloring the cloth (notwithstanding the type of the dye (whether it is an azo dye or a non-azo dye)), or by simultaneously carrying out a plurality of the combinations, a pattern of a color and/or ombre dyeing satisfying the objective can be produced freely.

By changing the type of a base material, the metabolizing temperature and the metabolizing time, the degree of discharge printing can be modified (semi-discharge printing can be effected freely). Thus, a pattern such as "ombre" and the like can be produced freely.

Because discharge printing can be done at a relatively high temperature of 30 to 40° C., contaminated bacteria are mostly killed, which is therefore preferable from the respect of hygiene.

III. Decoloring test with microorganism "Achromobacter PR41-1"

(1) White discharge printing

EXAMPLE 1

Placing dry-type (normal) bouillon (200 ml; manufactured by NISSUI PARMACEUTICAL CO., LTD.) with addition of 0.02% of an azo dye ("Brilliant Yellow 7GL"; manufactured by SUMITOMO CHEMICAL CO., LTD.) into a 500 ml Sakaguchi flask, and inoculating therein the bacterial strain Achromobacter PR41-1 for 48 hrs stirring culture at 38° C., centrifuging the culture broth to collect the bacteria, followed by washing in 0.1 N phosphate buffer and centrifuging, the isolated bacteria (bacterial dispersion) was used, as it was, as a bacterial solution for discharge printing.

By using a direct azo dye "Kayarus Supra Red 6BL" (manufactured by NIPPON KAYAKU CO., LTD.) of a 3 wt % concentration, taffeta cloth of 100% rayon was dyed according to the routine method. The cloth was dyed in red color. On the cloth dyed in red color was placed a rubber plate, from which a star pattern was preliminarily cut out, and then, the bacterial solution for discharge printing was poured into the cut-out pattern. After removing the rubber plate, the cloth was kept wet and then placed in a thermostat at 30° C. for 24 hours for white discharge printing.

Consequently, the azo dye dyeing the cloth was completely metabolized, to produce a white star pattern on the red base. The cloth showed a brilliant pattern with no blurring in the border of the colors.

EXAMPLE 2

As in Example 1, white discharge printing was carried out in the present Example, except that (1) taffeta of 100% nylon was used as the cloth material; (2) an azo acid dye "Kayanol Milling Red BW" (manufactured by NIPPON KAYAKU CO., LTD.) of a 3 wt % concentration was used as the dye for dyeing the cloth (base color: red); (3) a rubber plate for charging a bacterial solution was used, from which a polka dot pattern was preliminarily cut out; and (4) the conditions for discharge printing were 40° C. and 16 hours.

Consequently, a white polka dot pattern was produced on the red base. Also in this case, a brilliant pattern was exhibited.

Because the azo acid dye "Kayanol Milling Red BW" has poor potential of discharge printing with a reducing agent, the dye is not used for general discharge printing. In the present Example, therefore, discharge printing could he carried out in a secure manner even if use was made of the azo acid dye which could not generally he used for discharge printing.

EXAMPLE 3

As in Example 1, white discharge printing was carried out in the present Example, except that (1) muslin of 100% wool was used as the cloth material; (2) an azo acid dye "Kayanol Milling Yellow 0" (manufactured by NIPPON KAYAKU CO., LTD.) of a 1 wt % concentration and an azo acid dye "Kayanol Milling Red RS 125" (manufactured by NIPPON KAYAKU CO., LTD.) of a 1 wt % concentration were used as the dyes for dyeing the cloth (base color: orange); (3) a rubber plate for charging a bacterial solution was used, from which a triangle pattern was preliminarily cut out; and (4) the conditions for discharge printing were 30° C. and 24 hours.

Consequently, the two types of the azo dyes dyeing the cloth were simultaneously metabolized, to produce a white triangle pattern on the orange base.

(2) Colored discharge printing

EXAMPLE 4

As in Example 1, colored discharge printing was carried out in the present Example, except that (1) broad cloth of 100% cotton was used as the cloth material; (2) an anthraquinone reaction dye "Mikasion Brilliant Blue RS" (manufactured by NIPPON KAYAKU CO., LTD.) of a 1 wt % concentration and an azo reaction dye "Remazol Red B 150" (manufactured by Mitsubishi Kasei Heochist Corporation) of a 1 wt % concentration were used as the dyes for dyeing the cloth (base color: purple); (3) a pattern was drawn on the dyed cloth by means of a brush, using the bacterial solution used in Example 1, and (4) the conditions for discharge printing were 40° C. and 12 hours.

Consequently, in the cotton cloth after the treatment, the azo dye coloring the cloth was metabolized, while the non-azo dye coloring the cloth remained unmetabolized, to prepare the pattern drawn on the purple base with the bacterial solution for discharge printing, into blue color (the color dyed with the anthraquinone dye). No blurring occurred in the border of the colors, to produce a brilliant pattern.

EXAMPLE 5

As in Example 1, colored discharge printing was carried out in the present Example, except that (1) muslin of 100% wool was used as the cloth material; (2) an anthraquinone acid dye "Alizarine Rubinol 3G 115%" (manufactured by Yamada Chemical Industry Co., Ltd.) of a 1 wt % concentration and an azo acid dye "Kayanol Navy Blue R" (manufactured by NIPPON KAYAKU CO., LTD.) of a 1 wt % concentration were used as the dyes for dyeing the cloth (base color: purple); (3) a rubber plate for charging a bacterial solution was used, from which a polka dot pattern was preliminarily cut out; and (4) the conditions for discharge printing were 40° C. and 12 hours.

Consequently, in the 100% wool cloth after the treatment, the azo dye dyeing the cloth was highly metabolized at 50° C. for a short period of time, while the non-azo dye was left unmetabolized, to produce a red polka dot pattern on the purple base. Also in this case, a brilliant pattern was exhibited.

EXAMPLE 6

As in Example 1, colored discharge printing was carried out in the present Example, except that (1) plain-woven fabric of 100% diacetate was used as the cloth material; (2) an azo dispersion dye "Kayalon fast Yellow G" (manufactured by NIPPON KAYAKU CO., LTD.) of a 3 wt % concentration and an azo dispersion dye "Kayalon Fast Rubine B" (manufactured by NIPPON KAYAKU CO., LTD.) of a 3 wt % concentration and an anthraquinone dispersion dye "Kayalon Fast Blue FN" (manufactured by NIPPON KAYAKU CO., LTD.) of a 3 wt % concentration were used as the dyes for dyeing the cloth (base color: black); (3) a rubber plate for charging a bacterial solution was used, from which a triangle pattern was preliminarily cut out; and (4) the conditions for discharge printing were 40° C. and 24 hours.

Consequently, the two types of the azo dyes dyeing the cloth were simultaneously metabolized, while keeping the non-azo dye unmetabolized as it was, to produce a blue triangle pattern on the black base. Also in this case, a brilliant pattern was exhibited.

EXAMPLE 7

As in Example 1, colored discharge printing was carried out in the present Example, except that (1) as the bacterial solution, use was made of a colored discharge printing solution produced by adding an azo acid dye "Kayanol Milling Yellow 3GW" (manufactured by NIPPON KAYAKU CO., LTD.) at 4 wt % to the bacterial solution used in Example 1; (2) wool was used as the cloth material; (3) an anthraquinone acid dye "Alizarine Rubinol 3G 115% (manufactured by Yamada Chemical Industry Co., Ltd.) and an azo acid dye "Kayanol Navy Blue R" (manufactured by NIPPON KAYAKU CO., LTD.) were used as the dyes for dyeing the cloth (base color: purple); and (4) a steaming process was carried out at 100° C. for 60 minutes after discharge printing, followed by washing in water and washing in warm water.

Consequently, the azo dye in the bacterial solution and the azo dye dyeing the cloth were nearly metabolized, while keeping the non-azo dye dyeing the cloth unmetabolized as it was, to produce a given pattern of approximately red color on the purple base.

EXAMPLE 8

As in Example 7, colored discharge printing was carried out in the present Example, except that (1) as the bacterial solution, use was made of a colored discharge printing solution produced by adding an azo acid dye "Kayanol Navy Blue R" (manufactured by NIPPON KAYAKU CO., LTD.) and an anthraquinone acid dye "Alizarine Rubinol 3G 115%" (manufactured by Yamada Chemical Industry Co., Ltd.), individually at 2 wt %, to the bacterial solution used in Example 1; (2) wool was used as the cloth material; (3) an azo acid dye "Kayanol Navy Blue R" (manufactured by NIPPON KAYAKU CO., LTD.) was used as the dye for dyeing the cloth (base color: blue).

Consequently, the azo dye in the bacterial solution and the azo dye dyeing the cloth were nearly metabolized, while keeping the non-azo dye in the bacterial solution unmetabolized as it was, to produce a given pattern of red to red purple color on the blue base.

EXAMPLE 9

As in Example 7, colored discharge printing was carried out in the present Example, except that (1) as the bacterial solution, use was made of a colored discharge printing solution produced by adding an anthraquinone acid dye "Suminol Fast Blue G" (manufactured by SUMITOMO CHEMICAL CO., LTD.) at 3 wt % to the bacterial solution used in Example 1; (2) wool was used as the cloth material; and (3) an azo acid dye "Kayanol Milling Yellow 0" (manufactured by NIPPON KAYAKU CO., LTD.) of 2 wt % and an azo acid dye "Kayanol Milling Red RS 125" (manufactured by NIPPON KAYAKU CO., LTD.) of 2 wt % were used as the dyes for dyeing the cloth (base color: orange).

Consequently, the two types of the azo dyes dyeing the cloth were nearly metabolized, while keeping the non-azo dye in the bacterial solution unmetabolized as it was, to produce a given pattern in blue on the orange base.

EXAMPLE 10

As in Example 7, colored discharge printing was carried out in the present Example, except that (1) as the bacterial solution, use was made of a colored discharge printing solution produced by adding an anthraquinone dispersion dye "Diacelliton Fast Pink R" (manufactured by Mitsubishi Kasei Heochist Corporation) at 3 wt % to the bacterial solution used in Example 1; (2) plain-woven fabric of 100% diacetate was used as the cloth material; (3) use was made of as the dyes for dyeing the cloth an azo dispersion dye "Kayalon East Yellow G" (manufactured by NIPPON KAYAKU CO., LTD.) of 1 wt %, an azo dispersion dye "Kayalon Fast Rubine B" (manufactured by NIPPON KAYAKU CO., LTD.) of 1 wt % and an anthraquinone dispersion dye "Kayalon Fast Blue FN" (manufactured by SUMITOMO CHEMICAL CO., LTD.) (base color: black); and (3) the conditions for steaming process were 100° C. and 30 minutes.

Consequently, the two types of the azo dyes dyeing the cloth were metabolized while the two types of the non-azo dyes in the bacterial solution and on the dyed cloth were kept unmetabolized as they were, to produce a given pattern of pale purple on the black base.

EXAMPLE 11

As in Example 7, colored discharge printing was carried out in the present Example, except that (1) as the bacterial solutions, use was made of Solution A produced by adding a non-azo reaction dye (an anthraquinone reaction dye) "Mikacion Brilliant Blue RS" (manufactured by NIPPON KAYAKU CO., LTD.) at 3 wt % to the bacterial solution used in the Example 1, and Solution B produced by adding the same reaction dye at 0.1 wt % to the bacterial solution; (2) cotton was used as the cloth material; (3) use was made of as the dye for dyeing the cloth a 2 wt % azo reaction dye "Remazol Red B150" (manufactured by Mitsubishi Kasei Heochist Corporation) to dye the cloth in red color; (4) an individually given pattern was drawn by using (either one of) the two types of the solutions, i.e. the Solution A and B; (5) the conditions for discharge printing were 40° C. and 12 hours and (6) the post-treatment conditions comprised immersing the cloth in an alkali solution (at 90° C.) for 15 seconds prior to washing in water, immersing then the resulting cloth in an aqueous 5 wt % acetic acid solution for 15 seconds prior to neutralization, and washing the cloth in warm water and then in water.

Consequently, the non-azo dyes of different concentrations in the bacterial solutions remained as they were, to produce the given pattern in two colors, namely dark blue and pale blue, on the red base.

The composition of the alkali solution described above was as follows. (The term "%" means "% by weight" hereinafter).

Anhydrous mirabilite; 10%, Sodium carbonate; 15%, Potassium carbonate; 5% Sodium hydroxide; 2% Sodium silicate; 1% Water; 67% (total 100%).

COMPARATIVE EXAMPLE

On the broad cloth of 100% cotton which was preliminarily dyed using an azo reaction dye "Remazol/Diamira Brill. Red 5B" (manufactured by Mitsubishi Kasei Heochist Corporation) of a 3 wt % concentration according to the routine method, was placed a rubber plate, from which a polka dot pattern was preliminarily cut out. Then, the following colored discharge printing paste was printed in the part of the cutout pattern. After drying, the cloth was steamed at 100° C. for 10 minutes, followed by an overheated steam process at 170° C. for 7 minutes prior to washing in water, and the cloth was then subjected to an oxidation process under the conditions of 5 g/liter sodium perborate, a bath ratio of 1:40, and 50° C. for 10 minutes, followed by washing and drying.

Composition of the colored discharge printing paste (The term "%" means "% by weight" hereinbelow.)

A thren dye "Mikethren Brilliant Blue R" (manufactured by Mitsui Toatsu Dyes Inc.), 3%; Rongalito C, 12%; potassium carbonate, 7%; aqueous 35% naphka crystal gum, 60%; glycerin, 3%; water, 15% (total 100%).

Consequently, a blue polka dot pattern was produced on the red base. In this case, equipment for steaming process is needed, and furthermore, a variety of chemicals should be required, involving furthermore complex procedures.

(3) Direct textile printing

EXAMPLE 12

In the present Example, as a colored discharge printing paste, use was made of a paste produced by adding an azo direct dye "Kayarus Supra Yellow RL" (manufactured by NIPPON KAYAKU CO., LTD.) at 4 wt % and a copper phthalocyanine direct dye "Sumilight Supra Turquoise Blue G conc." (manufactured by SUMITOMO CHEMICAL CO., LTD.) at 4 wt % % and British Gum at 10 wt % (qts. water) to the bacterial solution used in the Example 1, followed by kneading them together. Alternatively, dyeing habutae cloth of rayon 100% using an azo direct dye "Kayarus Supra Red 6BL" (manufactured by NIPPON KAYAKU CO., LTD.) of a 3 wt % concentration according to the routine method, the cloth was dyed in red. A pattern was drawn on the habutae of 100% rayon dyed in red, using the colored discharge printing paste squeezed from the tube. In the wet state, the cloth was put in a thermostat at 30° C. for 18 hours, and then after taking the cloth out of the thermostat, the cloth was subjected to steam processing at 100° C. at ambient pressure for 40 minutes, followed by washing in water and then in warm water.

Consequently, the two types of the azo dyes in the paste and the dyed cloth were nearly metabolized (a certain degree of the azo dye in the paste remained.). Concurrently, the non-azo dye in the paste remained unmetabolized, to produce a pattern in dim green blue on the red base.

(4) With respect to the degree of discharge printing

EXAMPLE 13

As in Example 1, testing was carried out, except that (1) use was made of the bacterial solution used in the Example 1; (2) two types of cloths, namely rayon or cotton, were used for individual dyeing with an azo direct dye "Kayarus Supra Yellow RL" (manufactured by NIPPON KAYAKU CO., LTD.) (base color: yellow); and (3) the discharge printing conditions were 40° C. and 36 hours.

Consequently, in the case of the cotton, the coloring with the azo dye was completely decolored, while in the case of the rayon, the coloring got pale but was not completely decolored. In the case of the rayon, furthermore, the same process was carried out at the same temperature over 72 hours, so that the coloring was nearly completely decolored. Thus, it is indicated that the coloring of the azo dye was decolored or decreased, depending on the conditions. Simultaneously, it is also indicated that the decoloring degree varies depending on the type of the cloth and the metabolizing temperature.

EXAMPLE 14

As in Example 1, semi-colored discharge printing was carried out, except that (1) use was made of a colored discharge printing solution produced by adding an azo direct dye "Kayarus Supra Yellow RL" (manufactured by NIPPON KAYAKU CO., LTD.) at 3 wt % to the bacterial solution used in the Example 1; (2) rayon was used as the cloth material; (3) as the dye for dyeing the cloth, use was made of a 3 wt % anthraquinone reaction dye "Mikacion Brilliant Blue RS" (manufactured by NIPPON KAYAKU CO., LTD.) (base color: blue) and (4) the conditions for discharge printing were 40° C. and 12 hours.

Consequently, not the whole azo direct dye was metabolized, but some of the dye remained, to produce a blue pattern tinted with green on the blue base. As has been described above, semi-discharge printing was effected using such rayon material under the discharge printing conditions, so that ombre dyeing could be achieved.

EXAMPLE 15

As in Example 12, direct discharge printing was carried out, except that (1) as the colored discharge printing solution, use was made of Paste A (green) produced by adding a copper phthalocyanine direct dye "Sumilight Supra Turquoise Blue G conc." (manufactured by SUMITOMO CHEMICAL CO., LTD.) at 4 wt %, an azo direct dye "Kayarus Supra Yellow RL" (manufactured by NIPPON KAYAKU CO., LTD.) at 4 wt % and British Gum at 10 wt % (qts. water) to the bacterial solution used in the Example 1, and Paste B containing all of them, excluding only the azo direct dye "Kayarus Supra Yellow RL"; (2) habutae of rayon 100% was used as the cloth material, which was not dyed; and (3) an individually given pattern was drawn on the cloth, independently using the two types of the Pastes (Pastes A and B).

Consequently, under the discharge printing conditions, a part of the azo dye in the Paste A was metabolized. Because no metabolizable azo dye was contained in the paste B, however, two types of patterns in blue tinted with green (partially metabolized portions) and in blue were produced on the white base.

EXAMPLE 16

As in Example 1, discharge printing process was carried out, except that (1) use was made of an azo direct dye "Kayarus Supra Red 6BL" (manufactured by NIPPON KAYAKU CO., LTD.) of a 2 wt % concentration as the dye for dyeing cloth (base color, red); (2) the discharge printing conditions were 40' C. and 6 hours, 12 hours or 24 hours.

The results were similar to those depicted in the FIGURE.

(5) Advantages of Examples

As apparently shown in the metabolism of any of all the various azo dyes (reaction dyes, direct dyes, acid dyes and dispersion dyes) and non-metabolism of the non-azo dyes (anthraquinone reaction dyes, anthraquinone acid dyes, anthraquinone dispersion dyes and copper phthalocyanine direct dyes), the bacterial strain has excellent selectivity and wide applications to the metabolizable azo dyes.

Additionally, various azo dyes in the bacterial solution and various azo dyes dyeing cloth were metabolized. Furthermore, various azo dyes coloring a variety of base materials were also metabolized, although its metabolic degree varied. Therefore, by selecting the combination of a type of a dye (notwithstanding the type of the dye (whether it is an azo dye or a non-azo dye) in the bacterial solution and the like and a type of a dye coloring the cloth (notwithstanding the type of the dye whether it is an azo dye or a non-azo dye), or by simultaneously carrying out a plurality of the combinations, a pattern of a color and/or ombre dyeing satisfying the objective can be produced freely.

By changing the type of a base material, the metabolizing temperature and the metabolizing Lime, the degree of discharge printing can be modified (semi-discharge printing can be effected freely). Thus, a pattern such as "ombre" and the like can be produced freely.

Because discharge printing can be done at a relatively high temperature of 30 to 40° C., most of contaminated bacteria are killed, which is therefore preferable from the respect of hygiene.

The present invention is not limited to the specific Examples described above, and various modified examples may be made within the scope of the present invention, depending on the objective and utility. More specifically, the combination of a dye contained in a bacterial solution and a dye contained in a base material and the type of the base material ma bee modified besides those in the above Examples. Furthermore, the number of the dyes to be used in combination may be a number other than those described in the Examples, with no specific limitation. Additionally, the metabolizing (reaction) conditions may be selectively varied within the temperature range allowing the bacterial growth. Because the fixation of such dyes is carried out in an alkali solution, the fixation may be performed not only through the immersion in an alkali solution, but also by microencapsulating the alkali solution and decomposing the resulting microcapsule via temperature or with shear force.

TABLE 1

Dye groupings for dyeing

| Base material | Dyes | Chemical structure | Dyeing characteristics |
|---|---|---|---|
| Cellulose<br>cotton<br>linen | direct dye | Plane structure with a sulfonate group or a caboxy-late group | Dyeing is easy. Excellent uniform dyeing. Low fastness. High brilliancy is hardly produced |
| viscose rayon<br>cuprammonium rayon | naphthol dye | Azo compound of naphthol AS with an aromatic amine | Composed of a preliminary immersing agent and a developer, for carrying out diazo coupling on fiber. |
| | reaction dye | Having a reaction group and a sulfonate group | Covalent bonding with fiber. High fastness. |
| Polyamide<br>wool<br>silk | acid dye | Having a sulfonate group | Dyeing is easy. |
| | acid mordant dye | Having a sulfonate group | Prepared into chromium complex during dyeing. |
| | metal complex salt acid dye | Complexed with chromium, cobalt, etc. | Dyeing is easy. High fastness. |
| Polyester<br>diacetate<br>triacetate | dispersion dye | Without a sulfonate group or a carboxylate group | Dispersed in a water- insoluble dispersant for use. |
| Acrylic fiber<br>cation dyeable polyester | basic dye | Having a tetraammonium group or a carbonium group | High brilliancy. |

What is claimed is:

1. A method of textile printing using a microorganism comprising the steps of:

depositing a solution or paste containing a bacterial strain Bacillus OY1-2 (Deposit No.: FERM 13118) of the genus Bacillus in a desirable pattern on a colored base material dyed with at least a dye selected from the group consisting of: at least one azo-system dye; a non azo-system dye; and combination thereof; and subsequently culturing said bacterial strain at a temperature of 30 to 50° C. for a time sufficient to entirely or partially metabolize said at least one azo-dye to eliminate or decrease said azo-dye on said colored base material within said pattern for textile printing.

2. A method of textile printing by microorganism according to claim 1, wherein on a part of said desirable pattern formed by depositing a solution or paste solution containing said bacterial strain is carried out at least one of a process selected from the group consisting of:

(1) a process of drawing a pattern, under heating to a temperature above 55° C.;

(2) a process of drawing a pattern with a composition selected from the group consisting of an alkali solution of pH 9.0 or more, an alkali paste of pH 9.0, an acid solution of pH 4.0 or less, and an acid paste of pH 4.0 or less; and (3) a process of drawing a pattern with a disinfectant.

3. A method of textile printing using a microorganism comprising the steps of:

depositing a solution or paste containing a bacterial strain Bacillus OY1-2 (Deposit No.: FERM 13118) of the genus Bacillus in a desirable pattern on a complexly colored base material dyed with at least two azo-system dyes; and subsequently culturing said bacterial strain at a temperature of 30 to 50° C. for a time sufficient to entirely or partially metabolize said dyes to eliminate or decrease said dyes on said colored base material within said pattern for textile printing.

4. A method of textile printing by microorganism according to claim 3, wherein on a part of said desirable pattern formed by depositing a solution or paste solution containing said bacterial strain is carried out at least one of a process selected from the group consisting of:

(1) a process of drawing a pattern, under heating to a temperature above 55° C.;

(2) a process of drawing a pattern with a composition selected from the group consisting of an alkali solution of pH 9.0 or more, an alkali paste of pH 9.0, an acid solution of pH 4.0 or less, and an acid paste of pH 4.0 or less; and (3) a process of drawing a pattern with a disinfectant.

5. A method of textile printing using a microorganism comprising the steps of:

depositing a solution or paste containing a bacterial strain Bacillus OY1-2 (Deposit No.: FERM 13118) of the genus Bacillus and a dye selected from the group consisting of: an azo-system dye; a non-azo-system dye; and combination thereof in a desirable pattern on a colored base material dyed with a dye selected from the group consisting of: a non-azo-system dye; an azo-system dye; and combination thereof; and subsequently culturing said bacterial strain at a temperature and time sufficient to entirely or partially metabolize said dye systems to eliminate or decrease said azo-system dye in said solution or paste and on said colored base material within said pattern for textile printing.

6. A method of textile printing by microorganism according to claim 5, wherein on a part of said desirable pattern formed by depositing a solution or paste solution containing said bacterial strain is carried out at least one of a process selected from the group consisting of:

(1) a process of drawing a pattern, under heating to a temperature above 55° C.;

(2) a process of drawing a pattern with a composition selected from the group consisting of an alkali solution of pH 9.0 or more, an alkali paste of pH 9.0, an acid solution of pH 4.0 or less, and an acid paste of pH 4.0 or less; and (3) a process of drawing a pattern with a disinfectant.

7. An isolated microorganism for decolorizing azo-system dye comprising:

a bacterial strain Bacillus OY1-2 (Deposit No.: FERM 13118) of the genus Bacillus, which metabolizes azo-system dyes thereby eliminating or decreasing said azo-system dyes.

8. A microorganism for decolorization of azo-system dye according to claim 7, which can proliferate at 20 to 50° C.

* * * * *